United States Patent [19]

Shimada

[11] Patent Number: 4,770,646

[45] Date of Patent: Sep. 13, 1988

[54] HIGH DENSITY ELECTRICAL CONNECTOR

[75] Inventor: Masashi Shimada, Sagamihara, Japan

[73] Assignee: Minnesota Mining and Manufacturing Company, St. Paul, Minn.

[21] Appl. No.: 60,642

[22] Filed: Jun. 11, 1987

[30] Foreign Application Priority Data

Jul. 4, 1986 [JP] Japan ..... 61-102874[U]

[51] Int. Cl.[4] ..... H01R 4/24

[52] U.S. Cl. ..... 439/395; 439/417

[58] Field of Search ..... 439/391, 395–407, 439/417–419

[56] References Cited

U.S. PATENT DOCUMENTS 4,193,201 3/1980 Van Horn ..... 439/395

4,525,020 6/1985 Yasumoto ..... 439/395

*Primary Examiner*—Joseph H. McGlynn

*Attorney, Agent, or Firm*—Donald M. Sell; James A. Smith; John C. Barnes

[57] ABSTRACT

A high density electrical connector comprising a connector body containing insulation displacement contact elements and a cover assembly having a first cover portion and a second cover portion between which electrical wires are retained. The first cover portion has contact insertion holes for receiving the ends of the contact elements. The second cover portion has a longitudinal slit extending from one end throughout a majority of its length for receiving the wires to be connected, has recesses on both sides of the slit for receiving the ends of the contact elements and has wire receiving grooves passing from the slit across the recesses to the edge of the second cover portion.

5 Claims, 2 Drawing Sheets

HIGH DENSITY ELECTRICAL CONNECTOR

FIELD OF THE INVENTION

The invention relates to a high-density connector, and particularly to such a connector for use in electrical connection between computer devices.

BACKGROUND OF THE INVENTION

In the prior art, there is a connector for electrical connection of a flat-ribbon cable, as described in, for example, Japanese Utility Model Laid-Open Publication No. 26768/1985. In the connector described in that publication, a flat-ribbon cable is held in a cable guide groove and cable holding grooves to be subjected to insulating displacement, both of which grooves are formed in a cover.

When a connector of that type is used for electrical connection of a cable having discrete wires or twisted-pair wires, it is quite troublesome to pass discrete wires of a cable through the cable guide groove of the cover, and it is necessary prior to insulation displacement to adhesively bond respective wires to the cable holding grooves of the cover.

SUMMARY OF THE INVENTION

The present invention provides a high-density connector having a connector body provided with a multiplicity of insulation displacement contact elements and a cover assembly for retaining insulated electrical conductors. The cover assembly comprises a first cover portion and a second cover portion, the first cover portion being formed with contact insertion holes for receiving the conductor connecting ends of the contact elements in the connector body. The second cover portion is formed with a longitudinal slit that extends from one end of the second cover throughout a majority of the length thereof. The second cover portion is also formed with a multiplicity of contact recesses on opposite sides of the slit for receiving the ends of the contact elements and a multiplicity of transverse insulated electrical conductor receiving grooves, each extending from the longitudinal slit to the adjacent edge of the second cover, with one groove passing across each of the contact element receiving recesses.

THE DRAWING

DESCRIPTION OF THE PREFERRED EMBODIMENT

Figure 1:
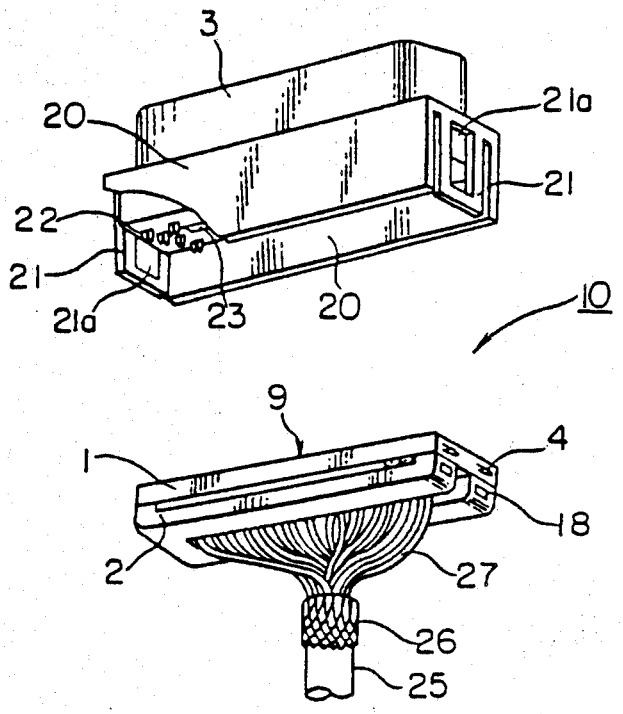
FIG. 1 is an exploded, perspective view of a high-density connector according to the invention.

Referring now to FIG. 1, a high-density connector 10 according to the invention is illustrated, and comprises a cover assembly 9 for mounting the insulated electrical conductors 27 of a cable 24, and a connector body 3 containing a multiplicity of insulation displacement contact elements 22. The cover assembly 9 comprises a first cover portion 1 and a second cover portion 2. The cover portions 1 and 2 and body 3 are formed of an insulating plastic material.

Figure 2:
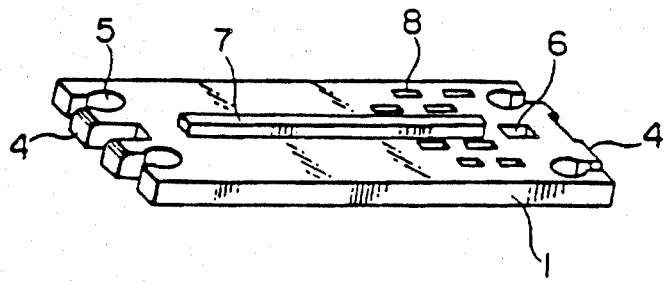
FIG. 2 is a perspective view of a first cover portion.

As illustrated in FIG. 2, the first cover portion 1 is formed with two pairs of first engaging projections 4, each pair of which are disposed on the longitudinally opposite ends of the first cover portion. The first cover portion also has press fitting holes 5 on the opposite sides of the first engaging projections 4, a misfit preventing hole 6 adjacent to one end of said first cover portion, a rib 7 extending longitudinally and centrally of the upper surface of said first cover portion, and a multiplicity of contact insertion holes 8 arranged in four rows and extending through the first cover portion.

Figure 3:
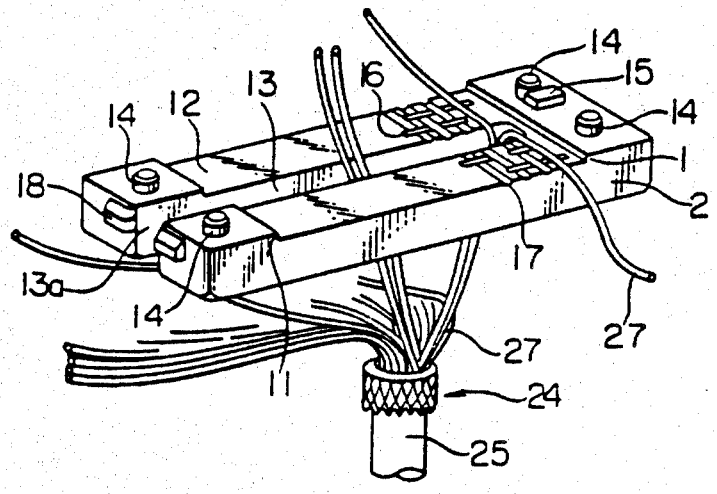
FIG. 3 is a perspective view of a second cover portion and an electrical cable.

As illustrated in FIG. 3, the second cover portion 2 is formed with stepped portions 11 on its upper surface at its ends, an insulated electrical conductor surface 12 disposed between said stepped portions, a longitudinal slit 13 extending through one of said stepped portions and the insulated electrical conductor bearing surface, two pairs of press fitting posts 14 on both stepped portions, a misfit preventing projection 15 on one of said stepped portions, and pairs of second engaging projections 18 on the opposite ends of said second cover.

As illustrated in FIGS. 2 and 3, in assembling the first and second cover portions 1, 2 to form the cover assembly 9, the first cover portion 1 is forceably applied to the second cover 2, in which the insulated electrical conductors 27 of a cable 25 have been placed, and the misfit preventing hole 6 and the press fitting holes 5 in the first cover are fitted on the misfit preventing projection 15 and the press fitting posts 14 on the second cover 2.

Figure 4:
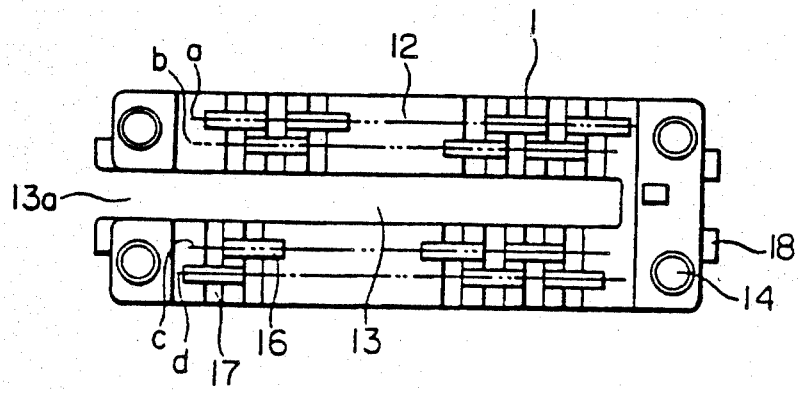
FIG. 4 is a plan view of the second cover portion.

As shown in FIGS. 3 and 4, the insulated electrical conductor surface 12 is formed with insulated electrical conductor receiving grooves 17 extending transversely to the length of the slit 13, and with contact receiving recesses 16 parallel to the slit 13 and arranged in rows a, b, c and d on the opposite sides of the slit. One groove 17 passes across each recess 16. Insulated conductor receiving grooves 17 are uniformly spaced, for example spaced 1.27 mm, and on the opposite sides of the slit 13 are disposed in offset relationship of, for example 0.635 mm, with the insulated conductor receiving grooves 17 disposed on the opposite side of the slit 13. Each insulated conductor receiving groove 17 has a semicircular shaped cross-section which is sized to accommodate different wire sizes. The contact receiving recesses 16 extend transversely to the length of each cable holding groove 17 and are arranged in rows a, b, c and d on either side of the slit 13 such that the contact receiving recesses 16 in rows a and b are offset by, for example, 0.635 mm with respect to the contact receiving recesses 16 in rows c and d.

Referring to FIG. 1, the connector body 3 contains a multiplicity of insulation displacement contact elements 22 mounted in the insulating plastic body, a pair of opposed side walls 20 extending from the body, and a pair of opposed resilient legs 21. The resilient legs 21 are formed with slots 21*a* which receive the first engaging projections 4 of the first cover portion and the second engaging projections 18 of the second cover portion when the connector body 3 is joined with the cover assembly 9.

While the high-density connector 10 according to the invention, can be applied on a flat-ribbon cable, it is particularly useful for a cable 24 having discrete insulated conductors 27 or twisted-pair wires. For that reason, mounting of the present high-density connector to such a cable is described hereinbelow. First, a cable covering 25 and a cable sheath 26 are stripped off from the cable 24, and discrete insulated electrical conductors 27 of the cable are introduced through a slit opening 13*a* into the slit 13. The insulated conductors 27 are then placed in the insulated conductor receiving grooves 17 of the second cover portion 2. Thereafter, the first cover portion 1 is placed on and forceably applied to the second cover portion 2 to retain the insulated electrical conductors between the first cover portion and the second cover portion. In this step the misfit preventing projection 15 and the press fitting posts 14 on the second cover portion 2 are tightly fitted into the misfit preventing hole 6 and the press fitting holes 5 in the first cover 1 to hold the cover portions 1 and 2 together. In this condition, the portions of the insulated conductors 27, which protrude laterally from the cover assembly 9, are cut. As the height of the steps 11 on the second cover portion 2 and the cross-section of each insulated conductor retaining groove 17 are sized so as to accommodate several cables having different wire sizes, the insulated conductors 27 are securedly retained between the first and second covers 1, 2.

Conventional insulation displacement connection to the insulated conductors is made by joining the connector body 3 to the cover assembly 9 with the ends of the insulation displacement contact elements 22 passing through the contact insertion holes 8 through the first cover portion 1 to make insulation displacement connection to the insulated conductors 27. In this condition, the resilient engaging legs 21 of the connector body 3 snap over and engage the first engaging projections 4 and the second engaging projections 18 of the cover assembly 9 in the slots 21*a*. Side walls 20 of the connector body 3 enclose the cover assembly 9 to eliminate the need for any closed end cover. In addition, the longitudinal rib 7 on the first cover portion is fitted into a central recess 23 in the connector body 3, so that any misalignment between the cover assembly 9 and the connector body 3 is eliminated during the step of insulation displacement.

I claim:

1. A high density electrical connector comprising a connector body containing a multiplicity of insulation displacement contact elements and a cover assembly for retaining insulated electrical conductors, said cover assembly including a first cover portion and a second cover portion, said first cover portion having contact insertion holes for receiving the conductor connecting ends of said insulation displacement contact elements and said second cover having a longitudinal slit extending from one end throughout a majority of the length of said second cover portion, a multiplicity of contact element receiving recesses on both sides of said longitudinal slit for receiving the ends of said contact elements extending through said contact insertion holes through said first cover portion and a multiplicity of transverse insulated electrical conductor receiving grooves, each extending from said longitudinal slit to the adjacent edge of said second cover, with one groove passing across each of said contact element receiving recesses.

2. The connector of claim 1 wherein said second cover portion has steps formed at both longitudinal ends of a height to define a spacing between the major portions of said first and second cover portions to firmly retain insulated electrical conductors between said cover portions in said insulated electrical conductor receiving grooves in said second cover portion.

3. The connector of claim 2 wherein said cover assembly has projections at its ends that mate with slots in resilient legs at the ends of said connector body to hold said body and said cover assembly together with the ends of the contact elements extending through said contact insertion holes in said first cover portion and being connected to insulated electrical conductors between said cover portions in said grooves.

4. The connector of claim 1 wherein said first cover portion has a central longitudinal rib and said connector body has a corresponding central recess to receive said rib when said body and cover assembly are assembled with the ends of the contact elements extending through said contact insertion holes in said first cover portion and being connected to insulated electrical conductors between said cover portions in said grooves.

5. The connector of claim 4 wherein said cover assembly has projections at its ends that mate with slots in resilient legs at the ends of said connector body to hold said body and said cover assembly together when they are assembled to connect said contact elements to the insulated electrical wires.

* * * * *